US007201155B2

(12) United States Patent
Mills

(10) Patent No.: US 7,201,155 B2
(45) Date of Patent: Apr. 10, 2007

(54) INTEGRAL VAPOR STORAGE AND VENT VALVE ASSEMBLY FOR USE WITH A SMALL ENGINE FUEL TANK AND VAPOR EMISSION SYSTEM EMPLOYING SAME

(75) Inventor: Vaughn K. Mills, Chelsea, MI (US)

(73) Assignee: Eaton Corporation, Cleveland, OH (US)

( * ) Notice: Subject to any disclaimer, the term of this patent is extended or adjusted under 35 U.S.C. 154(b) by 0 days.

(21) Appl. No.: 11/079,954

(22) Filed: Mar. 15, 2005

(65) Prior Publication Data

US 2006/0207575 A1 Sep. 21, 2006

(51) Int. Cl.
*F02M 33/04* (2006.01)
*F02M 33/02* (2006.01)

(52) U.S. Cl. ..... 123/520; 123/509

(58) Field of Classification Search ..... 123/516, 123/518, 519, 520, 509, 198 D
See application file for complete search history.

(56) References Cited

U.S. PATENT DOCUMENTS 4,028,075 A 6/1977 Roberge
5,170,765 A * 12/1992 Hoshino et al. ..... 123/520
5,355,861 A * 10/1994 Arai ..... 123/519
6,182,693 B1 * 2/2001 Stack et al. ..... 137/565.17
6,273,070 B1 * 8/2001 Arnal et al. ..... 123/519
6,422,255 B1 * 7/2002 Hartke et al. ..... 137/12
2001/0029932 A1 * 10/2001 Ozaki et al. ..... 123/520
2002/0125254 A1 * 9/2002 Hagano et al. ..... 220/562
2003/0205272 A1 * 11/2003 Benjey et al. ..... 137/202
2004/0237945 A1 * 12/2004 Veinotte ..... 123/520
2005/0133096 A1 * 6/2005 Brunel et al. ..... 137/565.17
2005/0178368 A1 8/2005 Donahue
2005/0284450 A1 * 12/2005 Mills ..... 123/519

* cited by examiner

*Primary Examiner*—Mahmoud Gimie
(74) *Attorney, Agent, or Firm*—Anna M. Shih

(57) ABSTRACT

A combination vapor vent/rollover valve and surrounding storage canister are disposed in a common housing for positioning inside a small engine fuel tank. In one embodiment described, the canister surrounds the vapor vent/rollover valve which may include a gravity pressure relief valve and a vacuum relief valve. In another embodiment a pressure relief valve and adjacent storage canister are disposed in a common housing for positioning inside a small engine fuel tank.

22 Claims, 5 Drawing Sheets

INTEGRAL VAPOR STORAGE AND VENT VALVE ASSEMBLY FOR USE WITH A SMALL ENGINE FUEL TANK AND VAPOR EMISSION SYSTEM EMPLOYING SAME

BACKGROUND

The present specification, drawings and claims relate to fuel systems for small engines of the type less than about 25 horsepower (18.6 kilowatts) and which have found widespread use in garden tractors, riding mowers and portable power generating sets and other such appliances. Air cooled engines are widely used for such applications for compactness and reduced weight and may be closely cowled in certain of such applications. Engines employed in the aforesaid and other similar applications commonly have a fuel tank located proximate the engine and arranged for simplicity to have gravitational flow of fuel from the tank to the engine carburetor; however, in certain applications fuel pumps are employed.

In the above-mentioned small engine applications, the fuel tank is usually formed with a user removable cap or closure provided on a spud or filler tube extending from the tank; and, refueling is usually accomplished by manually pouring from a portable container and often requires use of a user provided funnel. The filler cap on such engine applications is typically provided with a vent passage for admitting make-up air into the tank as fuel is withdrawn during engine operation.

Recently it has been mandated that for such small engine applications fuel vapor emission to the atmosphere is prohibited and thus the use of such an open tank vent is not permissible. The entire fuel system must now be sealed to prevent fuel vapor escape to the atmosphere during periods of engine shutdown; and, it has further been required that the fuel vapor trapped in the system be stored and purged to the engine air inlet upon an engine operation. Thus, it has been necessary to add fuel vapor emission systems to small engine applications where heretofore no such requirements existed. This has particularly created problems where space is at a premium for compact or closely cowled air cooled engines.

In view of the extremely high volume mass production of small engines and the simplicity and commonality of the relatively small fuel tanks for such engines, it has been desired to provide a simple, easy to install and low cost vapor emission control system for such small engines and such a system which does not require redesign or retooling of the engine fuel tanks. Furthermore, it has been desired to provide fuel vapor emission control systems for small engines in a manner which has not significantly increased the volume of the fuel tank and engine in view of the space limitations in those applications and particularly where the engine is closely cowled.

BRIEF SUMMARY

The present specification, drawings and claims describe a solution to the above-described problem and provides an integral vapor storage device and vapor vent/rollover valve in a common housing which may be disposed within a small engine fuel tank and externally connected for atmospheric air inlet and vapor purge flow to the engine carburetor during engine operation. The integrally formed unit has the vapor storage device in the form of a canister, which may be charged with adsorbent, surrounding the float chamber of a vapor vent/rollover valve which may include a pressure relief valve and a vacuum relief valve. The unit thus formed is compact and conveniently configured so as to readily permit installation in a small engine fuel tank during formation of the tank.

DETAILED DESCRIPTION

Figure 1:
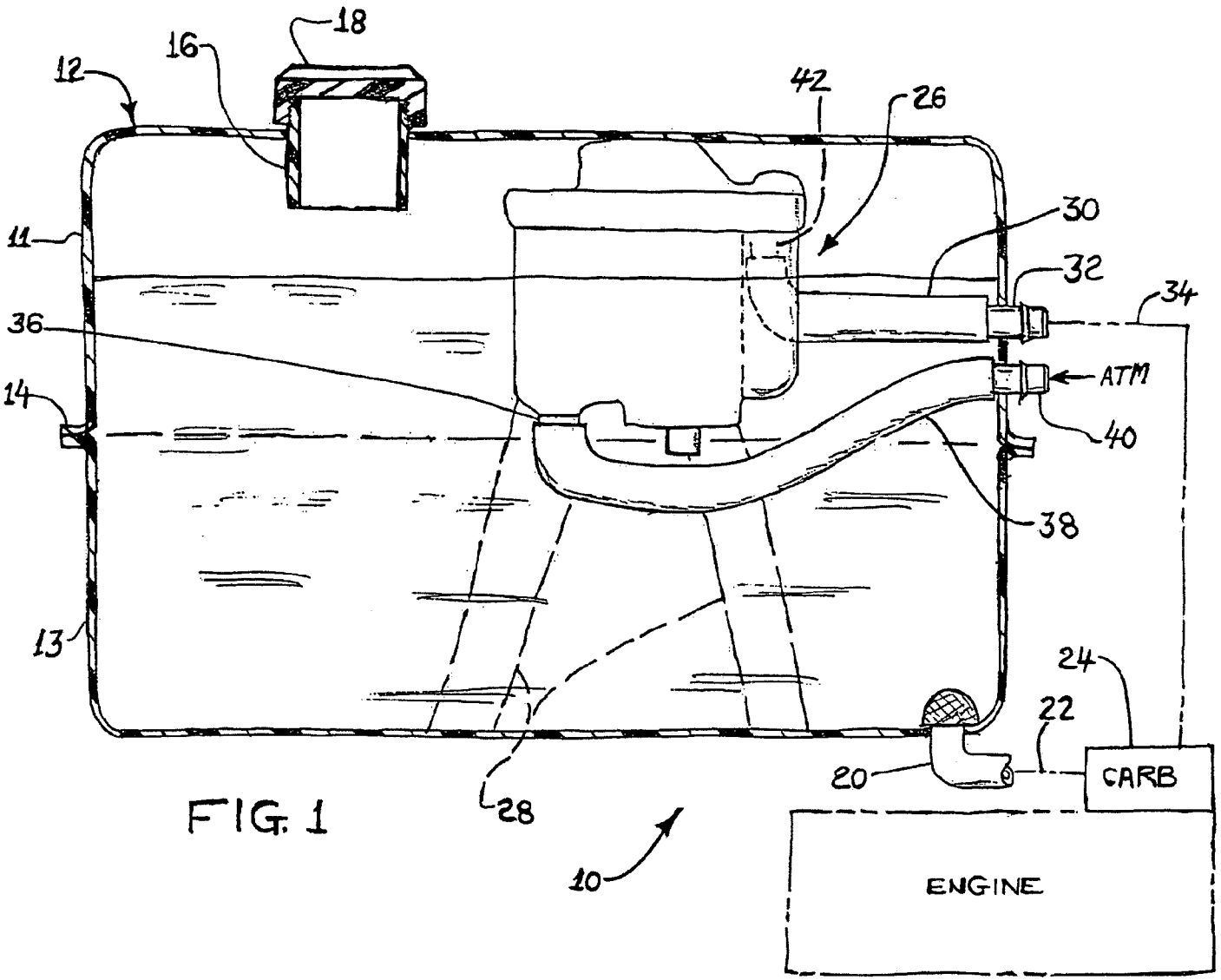
FIG. 1 is a pictorial schematic of an exemplary embodiment employed in a small engine fuel tank system.

Referring to FIG. 1, an exemplary embodiment of a small engine fuel system is indicated generally at 10 and includes a fuel tank indicated generally at 12 which may be formed by joining upper and lower half shells 11, 13 about a flanged rim 14 by any well-known expedient as, for example, ultrasonic or hotplate weldment. The tank 12 has a filler tube or spud 16 disposed through the upper wall thereof and sealed by a user removable cap or closure 18 which may be threadedly engaged on the spud 16. The tank has a gravity feed fuel line 20 disposed through the lower wall of the tank and which is connected via conduit 22 to the engine carburetor 24.

The integral vapor vent/tipping or rollover valve and vapor storage canister assembly is denoted generally at 26 and which may be, prior to the joining of the upper and lower shell halves about flange 14, either attached to the inside of the upper shell 11 or supported by a suitable support structure indicated by dashed outline and denoted by reference numeral 28.

Assembly 26 has a vapor purge outlet port 42 connected via hose 30 to an outlet fitting 32 extending through the wall of the tank and which is connected via conduit 34 to the air inlet of the engine carburetor 24. The assembly 26 also has an atmospheric purge fitting 36 provided thereon which is connected via hose 38 to a fitting 40 disposed through the wall of the fuel tank 12 and which permits entry of atmospheric air into the assembly 26 during purge as will hereinafter be described.

Figure 2:
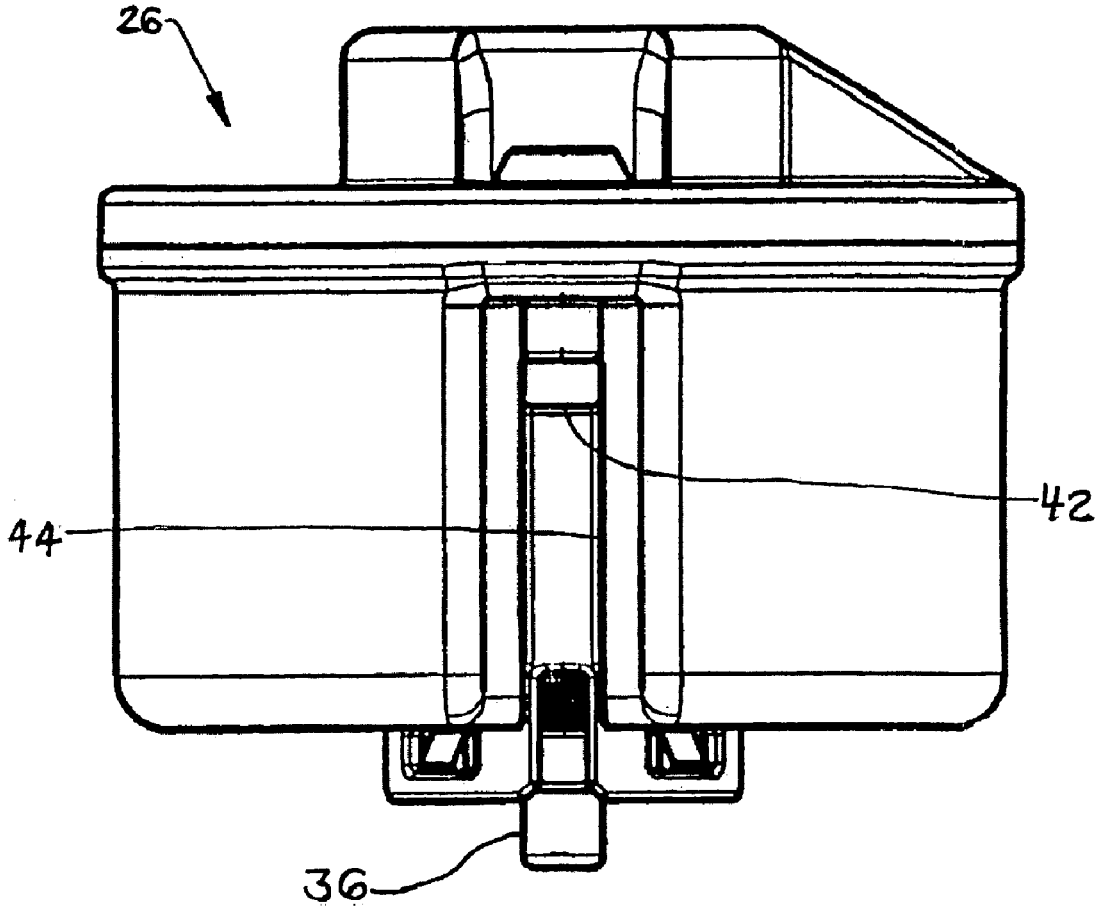
FIG. 2 is a side view of the integral vapor storage and vapor vent/rollover valve assembly of the embodiment of FIG. 1.

Referring to FIG. 2, the assembly 26 is shown with the purge outlet fitting 42 shown in a void or hollow 44 formed radially in the periphery thereof. Also illustrated in FIG. 2 for the assembly 26 is the atmospheric vent fitting 36 to which hose 38 is attached.

Figure 3:
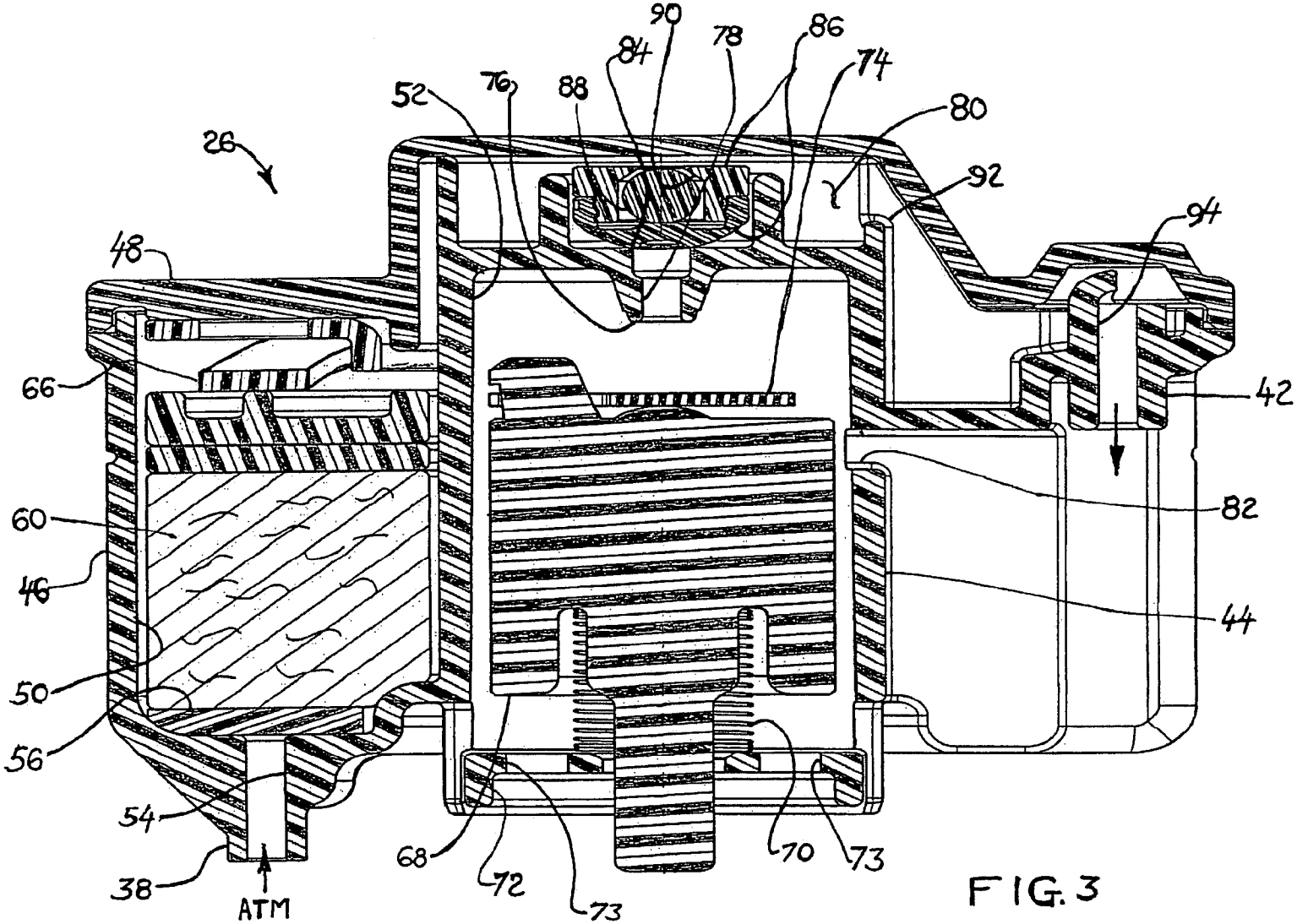
FIG. 3 is a cross-section of the assembly of FIG. 2.
Figure 4:
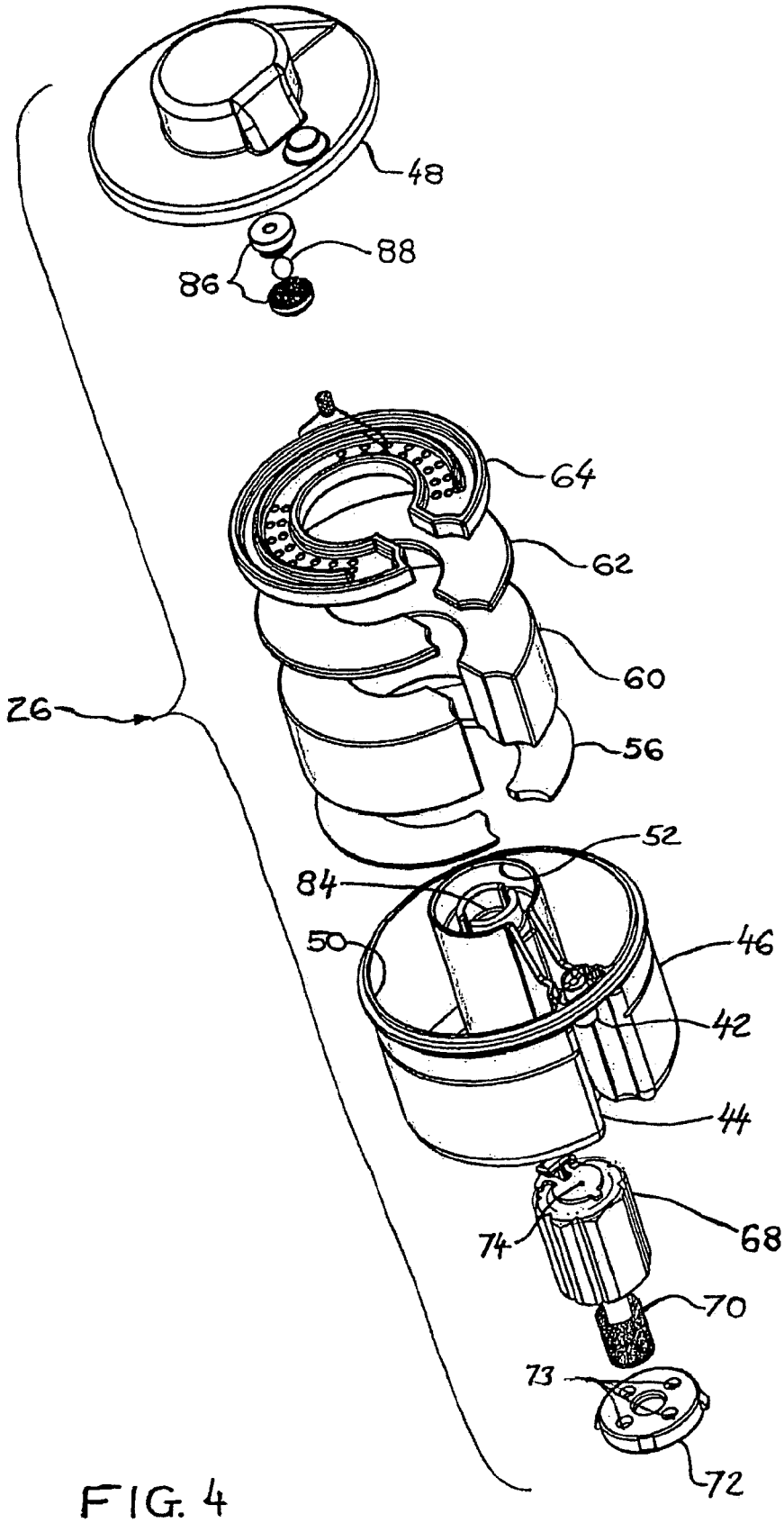
FIG. 4 is an exploded view of the assembly of FIG. 2.

Referring to FIGS. 3 and 4, the integral vapor vent/tipping valve and storage device assembly 26 is shown in further detail wherein a lower housing 46 has sealed thereover by any suitable expedient as, for example, weldment which may be accomplished by spin welding, friction welding or hotplate welding. The interior of the lower housing 46 forms a vapor storage space or canister 50 which is disposed adjacent a valving or float chamber 52; and, in the exemplary embodiment shown in FIG. 3 the storage chamber or canister 50 may have a generally annular configuration and may surround the float chamber 52 except for the radial void 44 formed in the periphery of the lower housing 46.

The atmospheric inlet fitting 38 has passage 54 formed therein which communicates the chamber 50 to the atmosphere; and, in the embodiment shown does so through a suitable layer of filter material 56. In the embodiment of FIG. 3 storage chamber 50 may have disposed therein a cartridge of adsorbent material 60 configured to conform to the interior configuration of the chamber 50. In the present practice, it has been found satisfactory to utilize particulate carbonaceous material such as granular charcoal for the adsorbent 60.

A retaining layer member 62 is disposed over the adsorbent cartridge 60 and the layer member 62 retained by a member 64 configured to retain the adsorbent by means of a spring 66.

A float 68 is disposed in chamber 52 and is retained therein by spring 70 and retainer 72 secured into the bottom of chamber 52. The float has disposed on the upper end thereof a flexible valve member 74 which, upon the float experiencing rising fuel level in the tank closes against a valve seat 76 formed on the lower end of a vapor vent passage 78 extending through the upper wall of the float chamber into a separate vapor purge chamber 80 formed under the cap 48 secured to lower housing 46, such as by weldment. The retainer 72 has a plurality of apertures 73 formed thereabout to permit liquid fuel to enter the float chamber 52. An additional port or aperture 82 is formed in the wall of the float chamber to allow fuel and vapor to enter the float chamber through the void 44.

The upper end of the vent passage 78 has a valve seat 84 formed thereon against which is seated a weighted or gravitationally responsive valve member 86.

If desired the valve member 86 may be formed in two pieces and may have a one-way vacuum vent valve 88 disposed therein for closing a valve seat 90 formed in the upper end of member 86 to permit reverse flow upon the chamber or purge passage 80 experiencing a sub-atmospheric pressure therein, to thus prevent collapse of the fuel tank.

Purge chamber 80 communicates through passage 92 to purge outlet 94. It will be understood that valve member 86 has its weight chosen so as to function as a pressure relief valve to maintain a slight positive pressure in the chamber 52.

The passage 92 communicates with the passage 94 formed in the fitting 42 which is connected via hose 30, fitting 32 and conduit 34 to the air inlet of the carburetor. It will be understood with reference to FIG. 3 that the chamber 50 communicates with the passage 92 and purge outlet 94 openly under the cap 48.

Figure 5:
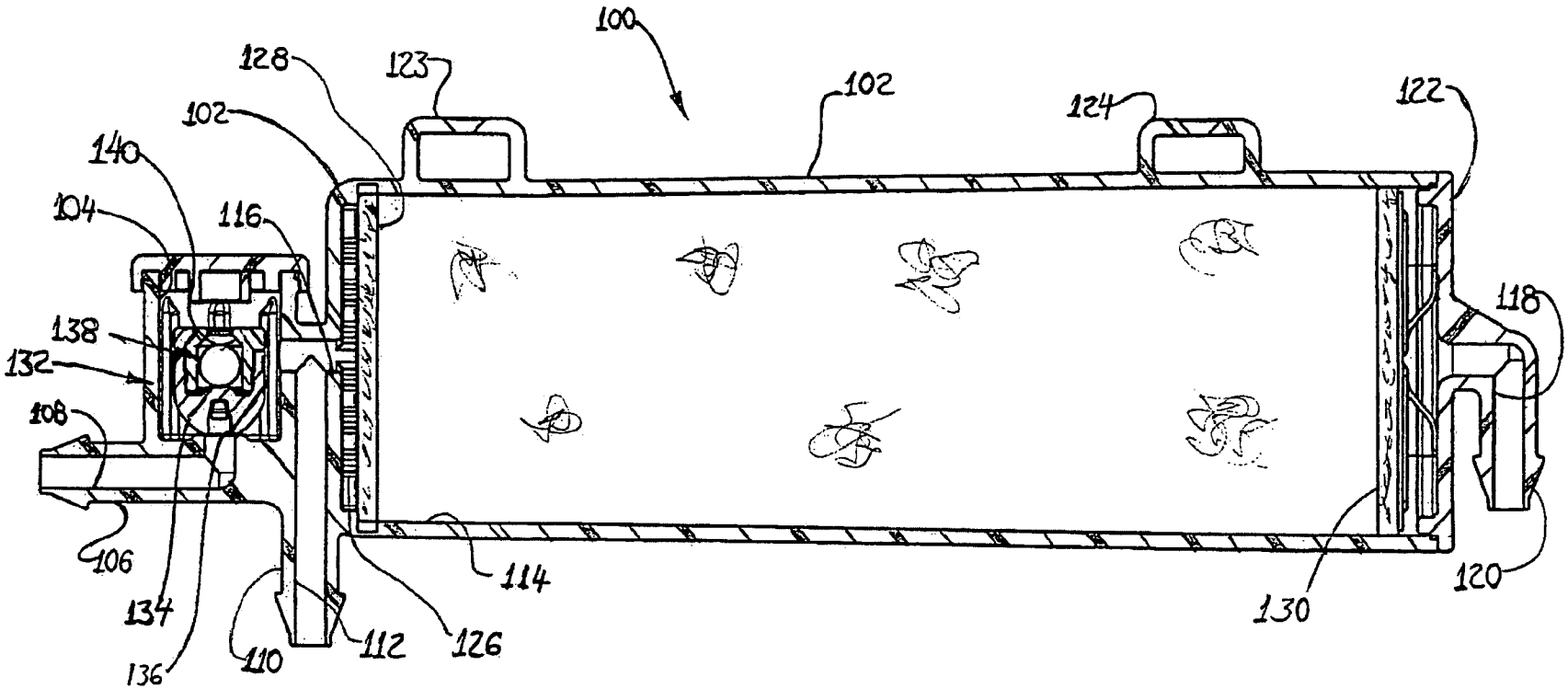
FIG. 5 is a cross-sectional view of another embodiment.

Referring to FIG. 5, another embodiment of the combined pressure relief valve and storage device is indicated generally at 100 and has an integrally formed housing 102 with a vapor chamber 104 formed therein having a vapor inlet fitting 106 with a vapor inlet passage 108 therein communicating with the chamber 104. A separate fitting 110 is formed thereon with a vapor purge or outlet passage 112 formed therein. The housing also defines a storage chamber 114 which is disposed adjacent the vent chamber 104 and communicates therewith through internal passage 116; and, the storage chamber 114 also communicates with an atmospheric vent passage 118 distal purge passage 112 formed in a separate fitting 120 which is integrally formed with a closure member or cap 122 secured and sealed over the end of the storage chamber 114 by any suitable expedient as, for example, weldment by ultrasonic or spin welding techniques.

The housing 102 includes mounting projections 123, 124 provided for attachment to the inside of the tank wall by any suitable expedient as, for example, fasteners, adhesive or weldment.

Passage 116 includes baffling surfaces 126 for flow dispersion at the entrance of the chamber 114. If desired, a layer of filter material 128 may be disposed over the baffling surfaces 126; and, in similar fashion a layer of filter material 130 may be disposed over the entrance of vent passage 118 into the chamber 114.

Chamber 104 has disposed therein a pressure relief valve indicated generally at 132 which includes a valve member 134 seated on a valving seat surface 136 formed at the chamber end of passage 108. The valve member 134 is formed of material such as metal, chosen to have member 134 serve as a gravity responsive member to maintain the valve seat 136 closed until a desired predetermined pressure is applied through passage 108 so as to overcome the weight of the member 134 and permit the valve to open at the desired pressure. The valve member 134 includes formed therein a vacuum relief valve indicated generally at 138 which moves away from valve seat 140 in response to a sub-atmospheric pressure in the passage 108 and chamber 104. The vacuum valve 138 is operative to admit vapor from the storage device chamber 114 provide make-up air to the tank and prevent collapse of the tank during withdrawal of fuel by the engine. It will be understood that the vacuum valve includes a feather light valve member, such as a plastic sphere, which closes the vacuum relief valve under a very slight positive pressure in chamber 104.

The embodiment of FIG. 5 thus provides an alternative to the assembly 26 of FIG. 1 inasmuch as the storage chamber is formed adjacent the pressure relief valve rather than surrounding it. The embodiment of FIG. 5 also permits remote mounting of a float operated rollover valve and thus provides additional flexibility of installation in a small engine fuel tank and fuel system.

The embodiments described and illustrated hereinabove thus provide a unique and novel integral combination of a vapor vent/tipping valve and vapor storage chamber which may contain adsorbent in a common housing and which is conveniently mountable within a fuel tank for a small engine and which is connected via hose fittings through the wall of the tank to receive atmospheric purge air and provide purge flow to the engine air inlet during engine operation.

Although the exemplary embodiment has been described and illustrated hereinabove, it will be understood that modifications and variations may be made by those skilled in the art within the scope of the following claims.

What is claimed is:

1. An integrated vapor storage canister and vapor vent valve assembly for use with a fuel tank for a small engine comprising:

a housing structure defining a valving chamber and a vapor purge outlet port; and a pressure relief valve disposed in said valving chamber and movable in response to a predetermined vapor pressure in said valving chamber to open the vapor purge outlet port, wherein said housing structure further defines a vapor storage chamber having a vapor passage communicating with said vapor purge outlet port.

2. The assembly defined in claim 1, wherein said vapor storage chamber includes vapor adsorbent material.

3. The assembly defined in claim 1, further comprising a tipping valve disposed in the vapor chamber that prevents fluid passage through said vapor purge outlet port when the assembly is tipped.

4. The assembly defined in claim 3, wherein said tipping valve includes a float operated valve.

5. The assembly defined in claim 1, wherein said pressure relief valve includes a vacuum relief valve permitting reverse flow of vapor from said vapor purge outlet port to said valving chamber when a lower vapor pressure is experienced in said valving chamber than in said vapor purge outlet port.

6. The assembly defined in claim 5, wherein said vacuum relief valve is disposed in a moveable valve member in said pressure relief valve.

7. The assembly defined in claim 1, wherein said vapor storage chamber has a generally annular configuration and surrounds said valving chamber.

8. The assembly defined in claim 1, wherein said vapor storage chamber is disposed adjacent said valving chamber.

9. The assembly defined in claim 1, wherein the housing structure further defines a purge air inlet that permits entry of atmospheric air into the assembly.

10. A method of controlling fuel vapor emission for a small engine comprising:

disposing a fuel tank near the engine;

connecting a fuel supply conduit from the tank to the engine;

disposing a float operated vent valve in a housing to open and close a vapor purge outlet port;

forming a vapor storage chamber in the housing;

connecting the vapor storage chamber to the vent valve;

disposing the housing in the tank and connecting the vapor purge outlet port to an air inlet of the engine; and, venting the vapor storage chamber to the atmosphere.

11. The method defined in claim 10, wherein said step of forming a vapor storage chamber includes forming a chamber having an annular configuration.

12. The method defined in claim 10, wherein the step of disposing a vent valve includes disposing a one-way check valve in a path of the vapor purge outlet port.

13. The method defined in claim 12, wherein the step of disposing a one-way valve includes disposing a vacuum responsive reverse flow valve in said one-way valve.

14. The method defined in claim 10, wherein the step of forming a vapor storage chamber includes disposing adsorbent material in the storage chamber.

15. A fuel vapor emission system for a fuel tank for a small engine comprising:

a fuel tank disposed proximate the small engine;

conduit means defining a liquid fuel flow path from the tank to the small engine; and, an integrated vapor storage canister and vapor vent valve assembly disposed within the tank and connected to an engine air inlet, the assembly including a housing structure defining a valving chamber with a fuel inlet port and a vapor purge outlet part; and a pressure relief valve disposed in said valving chamber and movable in response to a predetermined vapor pressure in said valving chamber to open the vapor purge outlet port, the housing structure further defining a vapor storage chamber having a vapor passage communicating with said vapor purge outlet port.

16. The system defined in claim 15, wherein said vapor storage chamber includes vapor adsorbent material.

17. The system defined in claim 15, further comprising a tipping valve disposed in the vapor chamber that prevents fluid passage through said vapor purge outlet port when the assembly is tipped.

18. The system defined in claim 17, wherein said tipping valve includes a float operated valve.

19. The system defined in claim 15, wherein said pressure relief valve includes a vacuum relief valve permitting reverse flow of vapor from said vapor purge outlet port to said valving chamber when a lower vapor pressure is experienced in said valving chamber than in said vapor purge outlet port.

20. The system defined in claim 19, wherein said vacuum relief valve is disposed in a moveable valve member in said pressure relief valve.

21. The system defined in claim 15, wherein said vapor storage chamber has a generally annular configuration and surrounds said valving chamber.

22. The system defined in claim 15, wherein said vapor storage chamber is disposed adjacent said valving chamber.

* * * * *